US006553610B1

(12) United States Patent
Shideler

(10) Patent No.: US 6,553,610 B1
(45) Date of Patent: Apr. 29, 2003

(54) MODULAR VACUUM CLEANING SYSTEM

(75) Inventor: Larry R. Shideler, Boise, ID (US)

(73) Assignee: Proteam, Inc., Boise, ID (US)

( * ) Notice: Subject to any disclaimer, the term of this patent is extended or adjusted under 35 U.S.C. 154(b) by 268 days.

(21) Appl. No.: 09/605,197

(22) Filed: Jun. 27, 2000

(51) Int. Cl.[7] ..... A47L 9/10
(52) U.S. Cl. ..... 15/327.5; 15/328
(58) Field of Search ..... 15/327.5, 328

(56) References Cited

U.S. PATENT DOCUMENTS

| | | | | |
|---|---|---|---|---|
| 1,803,160 A | | 4/1931 | Adams | |
| 3,165,774 A | * | 1/1965 | Barba | 15/327.5 |
| 3,180,071 A | * | 4/1965 | Nolte et al. | 15/328 |
| 4,011,624 A | | 3/1977 | Proett | |
| 4,216,563 A | * | 8/1980 | Cyphert | 15/321 |
| 4,287,635 A | * | 9/1981 | Jacobs | 15/321 |
| 4,314,385 A | * | 2/1982 | Wimsatt et al. | 15/321 |
| 4,393,536 A | | 7/1983 | Tapp | |
| 4,513,470 A | | 4/1985 | Toya | |
| 4,688,293 A | | 8/1987 | McCambridge | |
| 5,005,251 A | | 4/1991 | McLeod et al. | |
| 5,050,264 A | | 9/1991 | Breslin | |
| 6,243,912 B1 | * | 6/2001 | Grey | 15/320 |
| 6,393,656 B1 | * | 5/2002 | Paterson et al. | 15/327.5 |

* cited by examiner

*Primary Examiner*—Theresa T. Snider
(74) *Attorney, Agent, or Firm*—Robert L. Shaver; Frank J. Dykas; Stephen M. Nipper

(57) ABSTRACT

Disclosed is a vacuum cleaning device and system for maintaining the operability of a vacuum cleaner. The device has a releasably attachable/detachable filter unit and a releasably attachable/detachable motor unit. Various filter units and motor units are interchangeable.

11 Claims, 5 Drawing Sheets

MODULAR VACUUM CLEANING SYSTEM

BACKGROUND OF THE INVENTION

1. Field of the Invention

The present invention generally relates to vacuum cleaning machines, and more particularly, to systems for keeping vacuum cleaning machines operable.

2. Background Information

Commercial cleaning services can be and often are big businesses. Larger cleaning services may have dozens of crews cleaning numerous commercial buildings at all hours of the day and night. The work loads may be scheduled right down to the frequency or day of the week that certain tasks, such as dusting and vacuuming are performed. Everything has to run like clockwork, and if it doesn't, and schedules are disrupted, large and sometimes lucrative cleaning contracts may be lost to a competitor.

Vacuum cleaners are used to clean floors, carpets, window sills, furniture and a host of other things. A larger commercial cleaning service may possess hundreds of vacuum cleaners. What applies to commercial cleaning services also applies to institutions such as school districts, hospitals, air lines, cruise ship, government agencies, manufacturers, and retail business. These entities may also have tight cleaning schedules and own numerous vacuum cleaners.

There are different types of vacuum cleaners which are used for different applications. There are different types of vacuum cleaners. These include regular upright and canister vacuums, wet/dry and cyclonic filters, and HEPA filters, amongst others. Others use unique motors because of specialized power sources such as those found on cruise ships and airplanes. One of the more popular vacuum cleaners used by the commercial cleaning services and institutions enumerated above is the backpack vacuum cleaner. Backpack vacuum cleaners typically provide a backpack frame supported by shoulder straps and a hip belt similar to those found on camping backpacks. A vacuum cleaner, generally cylindrical in shape with a flow through vacuum pump and motor draws a suction through a filter bag is carried on the frame. The vacuum hose and tools extend out and around to the front when the backpack vacuum cleaner is carried on the back of the operator. They are popular because they are easily carried from floor to floor and in and out of buildings, and because they aren't dragged across the floor when in use, where they can and often do hit furniture, store fixtures, equipment and the like.

A major problem associated with the operation of vacuum cleaning devices has been the problem of downtime associated with vacuum cleaner malfunctions. Typically, in such a setting, a broken vacuum cleaner results in a cleaning crew, or individual cleaning, not being able to finish the cleaning job, thus disrupting carefully crafted work schedules. Such a possibility of breakage often results in businesses and cleaning crews needing to purchase extra vacuum cleaning systems in order to have backups. The cost and inconvenience of needing extra vacuums when only a certain number are needed does not tend to be efficient.

Another problem associated with the operation of vacuum cleaning devices has been the need to have a plurality of cleaning devices to cover all of an operator's cleaning needs. For instance, an operator may choose to own a regular vacuum, a wet/dry vacuum, a cyclonic filter vacuum, and a HEPA filter vacuum. For example, a theoretical manufacturing plant may have need for two wet/dry vacuums in parts of the plant, a HEPA vacuum cleaner in the "clean room" and a regular vacuum for the carpets and furniture in the front office. In this example, if the HEPA vacuum cleaner motor were to fail, no other vacuum cleaner in the inventory of this theoretical manufacturing plant can be substituted for it, and all cleaning operations in the "clean room" will cease until the HEPA unit can be repaired or replaced.

What is needed is a vacuum cleaning system whereby the defective component of the vacuum can be quickly and easily removed and replaced with a working component, thereby reducing downtime and improving overall efficiency of the cleaning system.

What is also needed is the ability to quickly change a single vacuum cleaner between various filtering modes.

Additional advantages and novel features of the invention will be set forth in part in the description as follows, and in part, will become apparent to those skilled in the art upon examination of the following, or may be learned by a practice of the invention. The advantages of the invention may be realized and attained by means of the instrumentalities and accommodations particularly pointed out in the appended claims.

SUMMARY OF THE INVENTION

The preferred embodiment of the present invention is a modular backpack vacuum cleaner and system for maintaining the operability of a vacuum cleaners and for increasing usability. This system is particularly useful when the suction creating means of a vacuum cleaner fails and when the user wants to switch from a first type of vacuuming to a second type of vacuuming (for instance, from wet/dry vacuuming to HEPA vacuuming).

The system requires locating the vacuum cleaner suction creating means in a first power unit chamber. Preferably, the suction creating means is further comprised of an electric motor which powers an impeller. This impeller, when so powered, establishes a suction. This suction creates an airflow in an intake port located in the power unit chamber and out an exhaust port of the power unit chamber. The electric motor is connected to a power source through use of an electrical connecting means, and an on/off switch may also be present for turning the motor on and off.

The vacuum cleaning system further comprises a separate filter unit chamber. Located within this filter unit chamber will be vacuum cleaner filter means. The filter unit chamber will have an intake port for receiving air containing a suspended particulate substance, and an exhaust port for venting air filtered by the filtering means into the power unit intake port. The intake port will be able to cooperate with a vacuum hose through a vacuum hose attachment means and preferably a filter will be used for separating, filtering, collecting and storing said particulate substance. The power unit's chamber will be able to be releasably attached and detached from the filter unit chamber.

Thus, there are two main times when a user might want to detach the power unit from filter unit: when the user wants to use a different filter unit and when the vacuum cleaner motor fails and the user wants to switch the malfunctioning power unit with a working one.

To switch filter units, the user would only have to detach the power unit chamber from the first filter unit, and then install the power unit chamber on the second filter unit.

To change power units the user would detach the chamber containing the malfunctioning unit from the working unit. For instance, if the suction creating means failed, the user would detach the power unit chamber from the filter unit chamber. Then the user would connect a replacement power unit chamber in lieu thereof, thereby making the vacuum cleaner system once again operable. The defective component can then be easily serviced either by the user or by shipping or delivering the chamber in question to a servicing center.

Still other advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

The present invention is a modular backpack vacuum cleaner and systems for maintaining the operability of vacuum cleaners and for increasing their usability.

Figure 1:
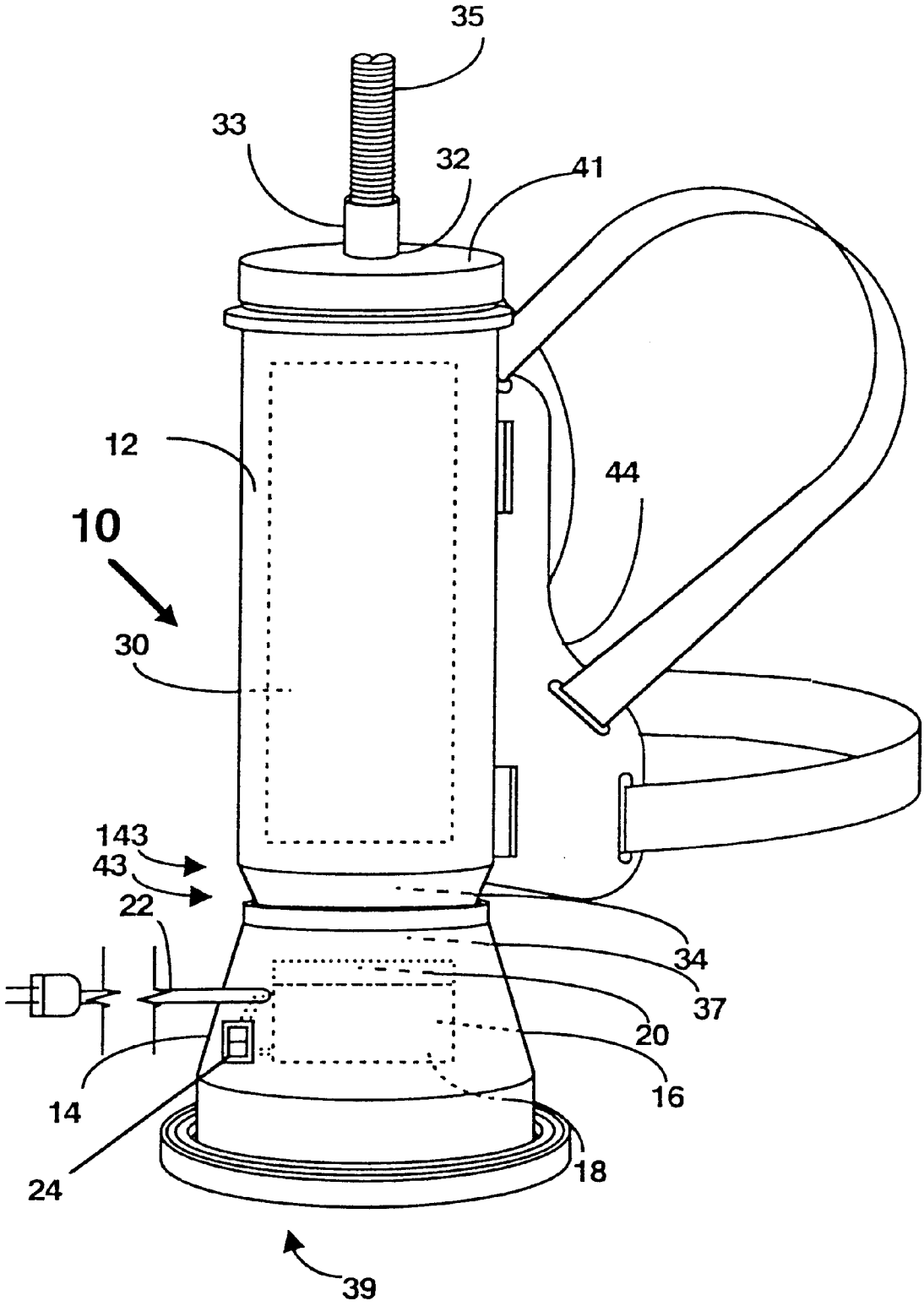
FIG. 1 is a side perspective view of a first embodiment of the present invention.

FIG. 1 shows a first embodiment of the present invention. The device 10 comprises two main parts. The first part is a filter unit 12, and the second part is motor unit 14. The filter unit 12 and the motor unit 14 are able to be releasably attached and detached from one another. It is preferred that the filter unit chamber intake port 32 be able to cooperate with a hose attachment means 33 for attaching to a vacuum hose 35, as is the standard in the use of backpack vacuum cleaners.

Figure 2:
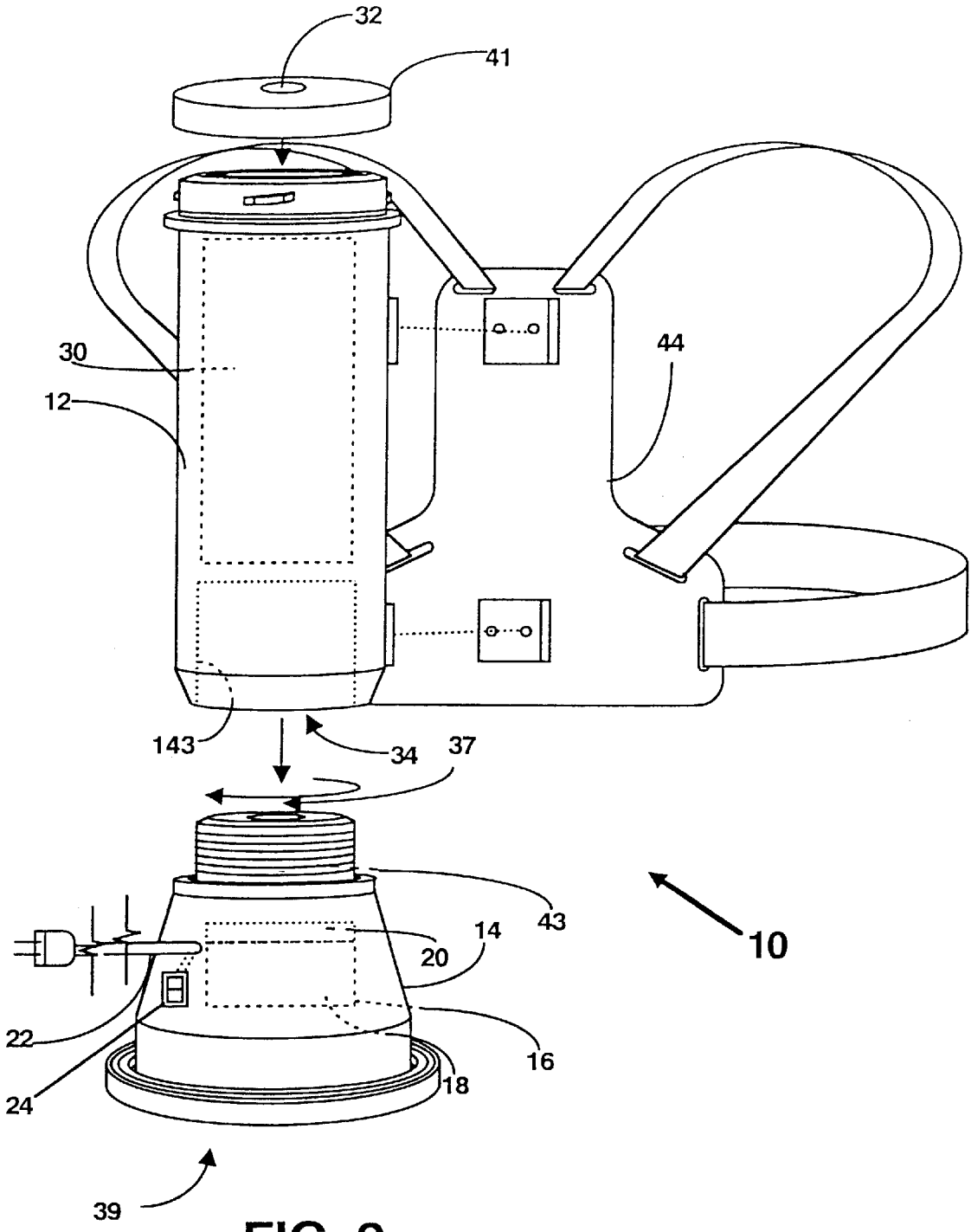
FIG. 2 is an exploded side perspective view of the first embodiment of FIG. 1.

In FIG. 2, the vacuum cleaning device 10 of FIG. 1 is shown in exploded view with the filter unit chamber 12 detached from the power unit chamber 14. As can be seen in this figure, the filter unit chamber 12 further comprises a filter unit chamber intake port 32, and a cap 41. The filter unit's chamber intake port 32 in this embodiment is located within the cap 41, however in other embodiments, the filter unit chamber intake port 32 may be located in other locations on the filter unit chamber 12 itself.

The power unit chamber 14 contains the suction creating means 16 for creation of suction through an attached filter unit chamber 12. Use of such a suction creating means is normal for the vacuuming industry. The power unit chamber 14 has a power unit chamber intake port 37 and a power unit exhaust port 39. The suction creating means, such as an electric vacuum motor 18 having an impeller 20, is used to draw air through the power unit intake port 37 and out the power unit exhaust port 39. When attached to a filter unit chamber 12, air carrying dust and dirt is able to be drawn by the suction creating means through a filter means 30 and exhausted.

The power unit chamber 14 is able to releasably connect with the filter unit chamber 12. In this embodiment, it can be seen that the power unit chamber 14 contains threadings that are received in a threaded recess of the filter unit chamber 12. As such, the filter unit would be screwed onto the motor unit, or vice versa.

What is envisioned is having multiple filter unit chambers able to be used for different purposes. For instance, a filter unit chamber could be created with a HEPA filter, and a filter unit chamber could be created with wet/dry filter. In order to convert the vacuum cleaning system from a HEPA vacuuming system to a wet/dry vacuuming system, the user would merely have to detach the power unit chamber 14 from the filter unit chamber containing the HEPA filter and, in lieu thereof, attach a filter unit chamber containing a wet/dry filtration system. There are many different types of filter types which could be put in separate filter unit chambers to expand the usability of the device.

Figure 3:
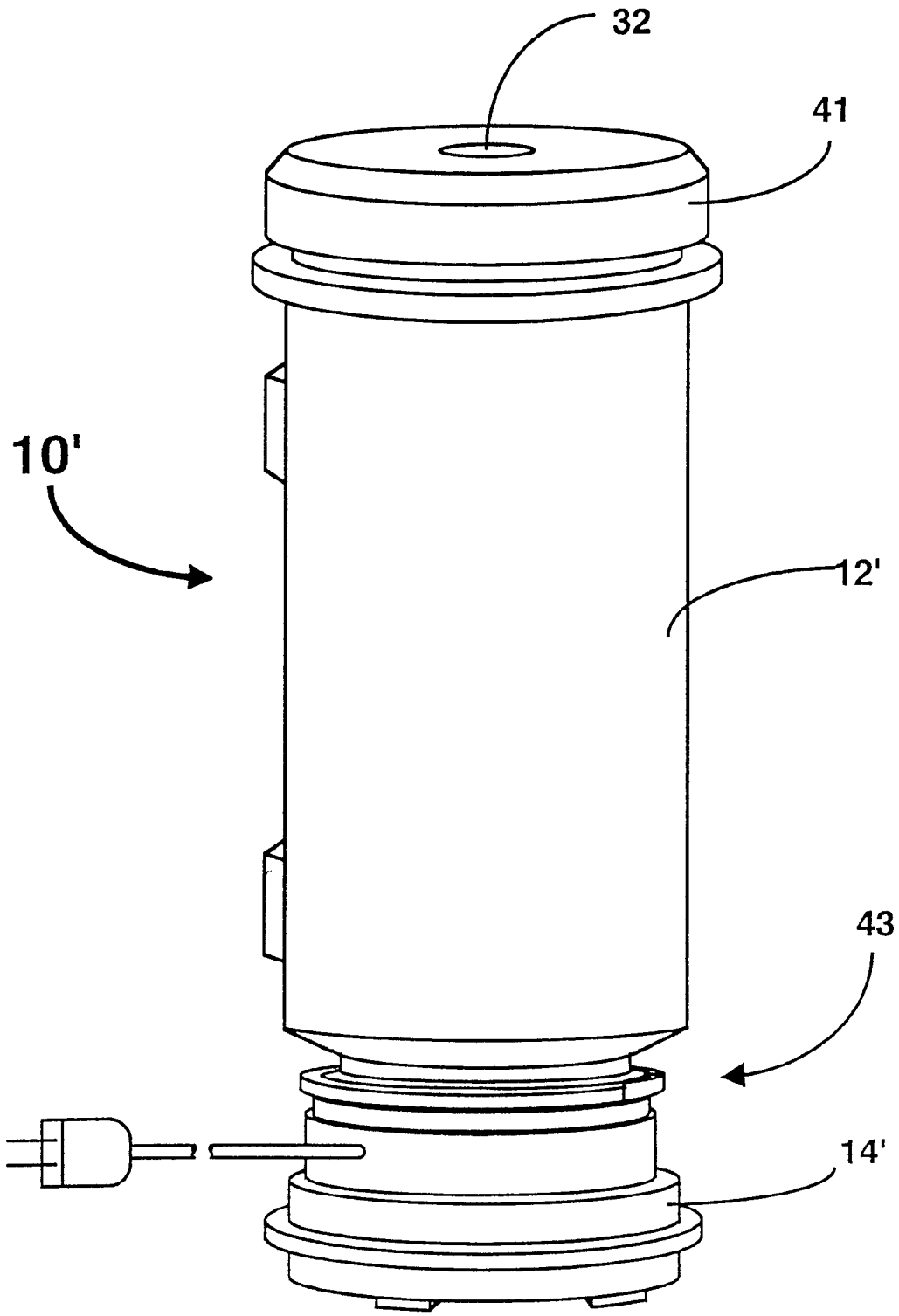
FIG. 3 is a side perspective view of a second embodiment of the present invention.

Now referring to FIG. 3, shown is another embodiment of the device 10'. This embodiment shows that the attachment of the filter unit chamber 12' to the power unit chamber 14' can be done through use of a draw catch.

The filter unit chamber 12' contains at least one filter means for separating, filtering, collecting and storing suspended particulate substances. The filter unit chamber 12' has at least one intake port 32 and at least one exhaust port 34 (shown in FIG. 4). The filter means (not shown) itself is located between the filter unit chamber intake port 32 and the filter unit chamber exhaust port 32. It is envisioned that the filter means can be cloth, paper, or other type of filter. The filter means may also be a cyclonic or other system which does not use a lob cloth, paper or other filter. The filter means could be HEPA, or wet/dry as well.

Figure 4:
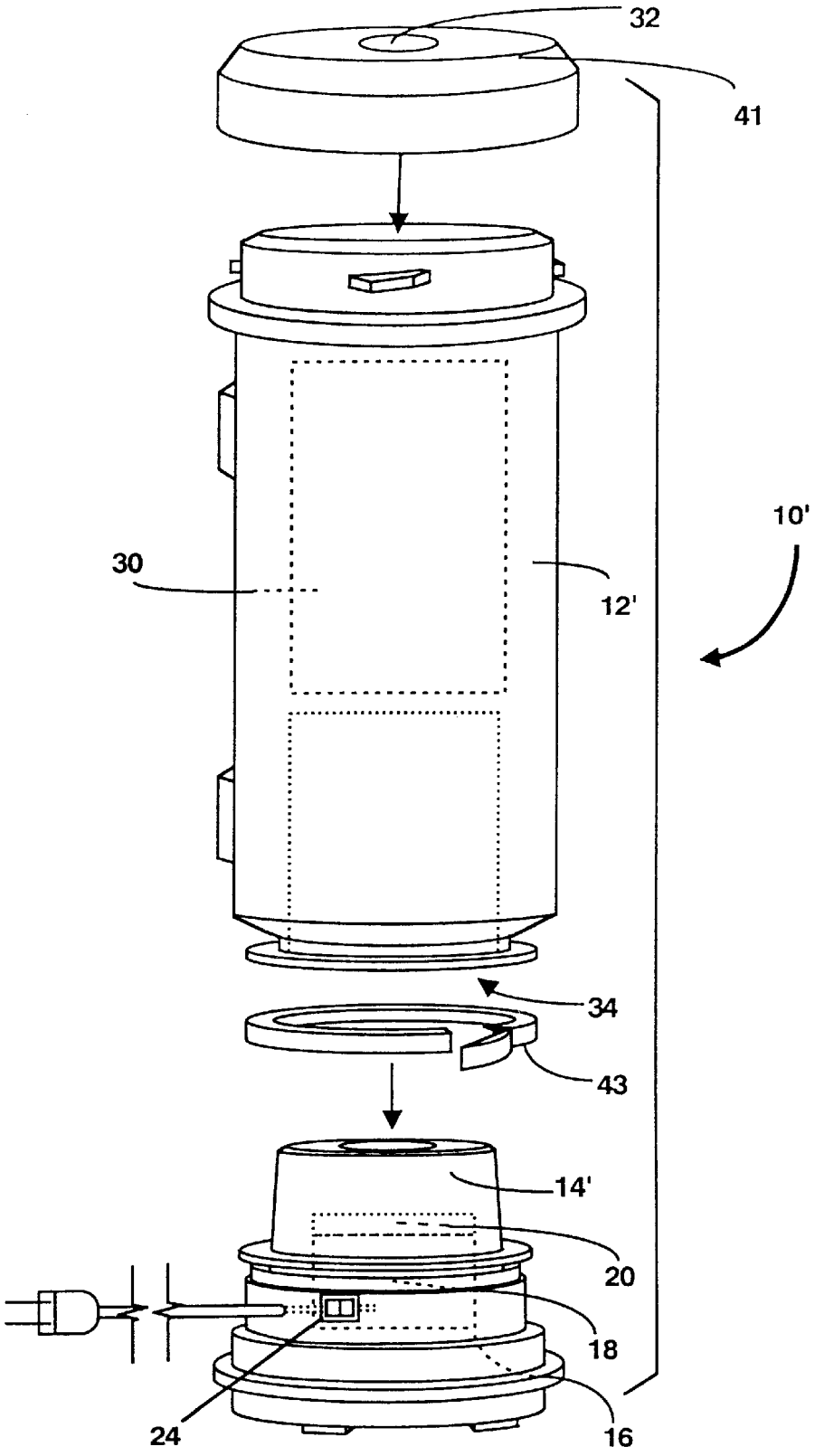
FIG. 4 is an exploded side perspective view of the second embodiment of the present invention as shown in FIG. 3.

Referring now to FIG. 4, the filter unit chamber 12' is able to releasably attach to the power unit chamber through a releasable filter unit chamber unit connection means 43 as discussed above. This releasable connection means 43 can be any method of releasable attachment, including pins, compression fittings, band fittings (as shown), and screw-type threading.

In the present invention, the power unit chamber 14 further comprises a suction creating means for creating air flow into the power unit chamber intake port 34 and out of the power unit chamber exhaust port 39. The suction creating means can be any means, including but not limited to, vacuum motors. When used in conjunction with an attached filter unit chamber, air is drawn through a vacuum hose, through the filter means of the filter unit chamber and is exhausted out of the exhaust port of the power unit chamber, thereby filtering the air drawn through the hose. The power unit us able to releasably attach to the filter unit through a releasable power unit chamber connection 143.

In the preferred embodiment, the suction creating means comprises an electric vacuum motor. This electric motor connects to a power source through use of a standard electrical connection 22. Use of a rechargeable or other battery system is also envisioned. An on/off means 24, switch, or other means may be located in line between the electric motor and the power source, thereby allowing the user to turn the motor on and off.

As discussed above, the vacuum may further comprise a backpack unit 44 for allowing the user to wear the modular vacuum cleaner in a backpack mode, the backpack unit having at least one shoulder strap for allowing the user to wear the backpack.

The invented vacuum cleaning system is also useful for maintaining the operability of a vacuum cleaner, particularly when one of the vacuum cleaner's components fail. This system involves forming or locating the vacuum cleaner's suction creating means in a first power unit chamber, and locating the vacuum cleaners filter means in a separate filtering chamber. This first power unit chamber and the filter unit chamber must be able to releasably attach to and detach from one another. The system permits the user to obtain or have a second power unit chamber and/or a second filter unit chamber on hand in case one of the components fails.

When the vacuum cleaning system fails, the user must determine whether the failure is due to a problem with the first power unit chamber or with the filter unit chamber. Once it is determined it is one of these units, the user merely has to detach the first power unit chamber from the filter unit chamber and exchange the defective unit with a replacement unit. The user will then be able to quickly put the vacuum cleaning system back in use. Ideally, the defective unit would then be repaired, either by the user repairing it him or herself later when the user has time or, the user would be able to send the defective unit off for servicing, while still being able to continue to use the vacuum cleaner system.

Figure 5:
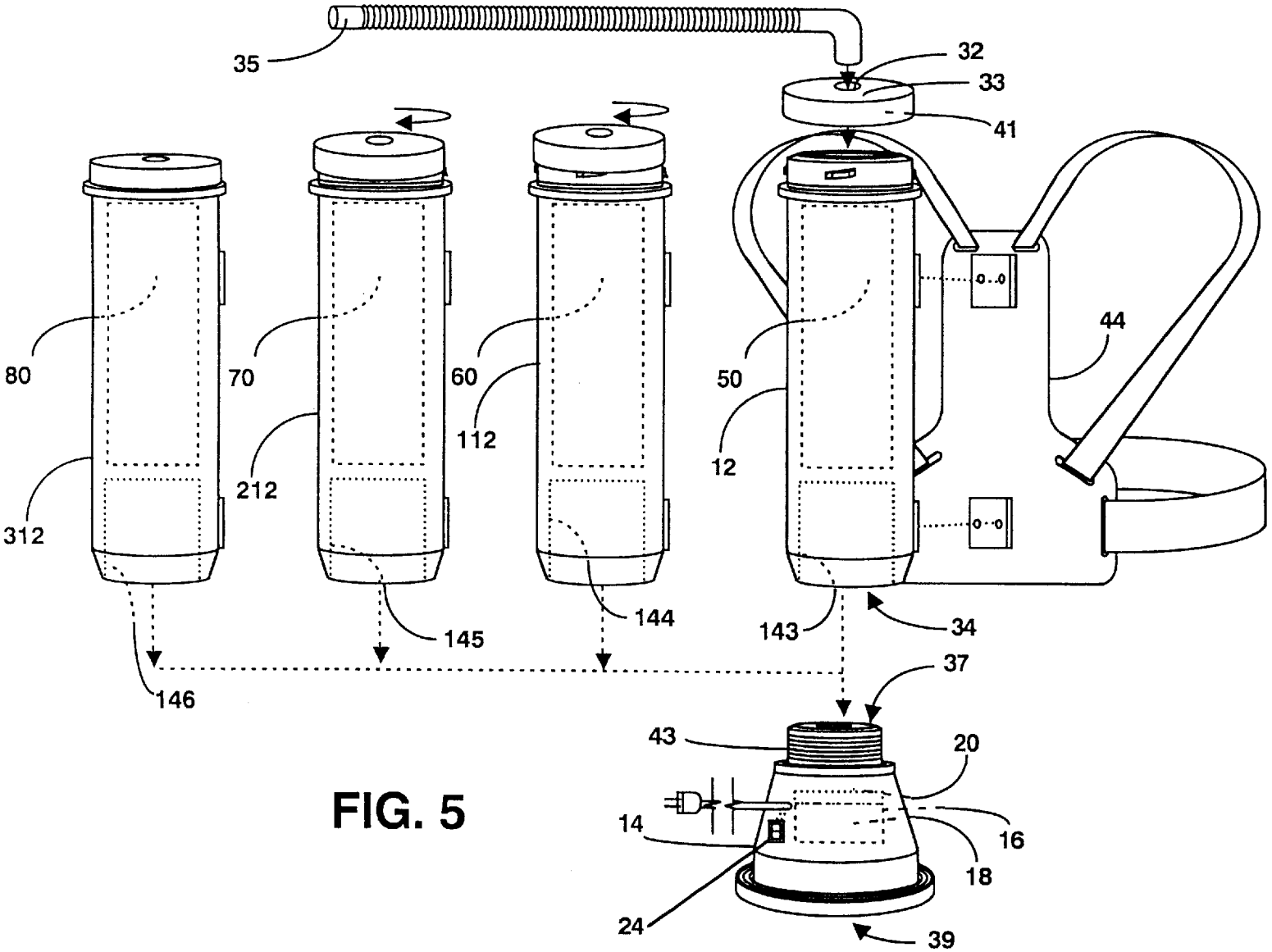
FIG. 5 is an exploded side view of the present invention's ability to provide for interchangeable filter unit chambers.

The modular ability of this vacuum cleaner system not only is in maintaining the operability of the vacuum cleaner, but also allows the user to swap out different power unit chambers and various filter units chambers to create the configuration of vacuum the user most desires. As shown in FIG. 5, one user may utilize numerous different filter unit chambers 12, 112, 212, 312. For instance, the first filter unit chamber 12 containing a HEPA filter 50, the second filter unit chamber 112 containing a cyclonic filter 60, the third filter unit chamber 212 containing a wet/dry filter 70 and the fourth filter unit chamber 312 containing a paper filter 80. Each of these filter unit chambers 12, 112, 212, 312 having, respectively, power unit chamber connections 143, 144, 145, 146. When the user wants to use a particular filter unit chamber, he/she can merely attach the preferred filter unit chamber to the power unit chamber. Changing function is as simple as detaching the previous filter unit chamber and attaching the preferred filter unit chamber. Likewise, a user is free to select a desired motor unit, and then choose a filter, for instance by tank size or shape or function (wet or dry, cyclonic, etc.).

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A modular vacuum cleaner comprising:

a power chamber unit, said power chamber unit containing a suction creating means powered by electrical connection with a power source, said power chamber unit further comprising a filter chamber unit connection means;

a first filter chamber unit containing therein a first filter means for removing particulate substances suspended in air, said first filter chamber unit further comprising a first power chamber unit connection means for connecting said first filter chamber unit with said power chamber unit, and a first backpack connection means;

a second filter chamber unit containing therein a second filter means for removing particulate substances suspended in air, said second filter chamber unit further comprising a second power chamber unit connection means for connecting said second filter chamber unit with said power chamber unit, and a second backpack connection means, said second filter chamber unit not connected to said first filter chamber unit; and a backpack unit configured to allow a user to wear the modular vacuum cleaner in a backpack mode, said backpack unit further comprising at least one shoulder strap wherein said backpack unit connects to one of said filter chamber units to releasably connect said backpack unit with one of said filter chamber units;

wherein said first and second power chamber unit connection means are each configured to cooperate with said filter chamber unit connection means thereby providing for the releasable connection of said power chamber unit to one of said filter chamber units.

2. The modular vacuum cleaner of claim 1, wherein said suction creating means further comprises:

an electric motor having an impeller for creating an airflow in an intake port and out an exhaust port, an electrical connection connecting said electric motor to the power source, an on/off means for turning said motor on and off, said intake port for receiving air from a filter chamber unit exhaust port, and, said exhaust port for exhausting air.

3. The modular vacuum cleaner of claim 2, wherein said first filter chamber unit further comprises:

a filter chamber unit intake port for receiving air containing the suspended particulate substances, said filter chamber unit intake port further comprising a hose attachment means for cooperation with a vacuum hose;

a vacuum hose for direction of suction formed by said suction creating means;

a filter means for separating, filtering, collecting, and storing said particulate substances, thereby creating filtered air; and said filter chamber unit exhaust port for venting said filtered air to said intake port.

4. The modular vacuum cleaner of claim 2, wherein said second filter chamber unit further comprises:

a filter chamber unit intake port for receiving air containing the suspended particulate substances, said filter chamber unit intake port further comprising a hose attachment means for cooperation with a vacuum hose;

a vacuum hose for direction of suction formed by said suction creating means;

a filter means for separating, filtering, collecting, and storing said particulate substances, thereby creating filtered air; and the filter chamber unit exhaust port for venting said filtered air to said intake port.

5. A modular vacuum cleaner comprising:

a power chamber unit, said power chamber unit containing a suction creating means, wherein said suction creating means is powered by electrical connection with a power source, said power chamber unit further comprising a filter chamber unit connection means;

a first filter chamber unit containing therein a HEPA filter unit for removing particulate substances suspended in air, said first filter chamber unit further comprising a first power chamber unit connection means for connecting said first filter chamber unit with said power chamber unit;

a second filter chamber unit containing therein a wet/dry filter unit, said second filter chamber unit further comprising a second power chamber unit connection means for connecting said second filter chamber unit with said power chamber unit;

a third filter chamber unit containing therein a paper filter unit for removing particulate substances suspended in air, said third filter chamber unit further comprising a third power chamber unit connection means for connecting said third filter chamber unit with said power chamber unit;

a fourth filter chamber unit containing therein a cyclonic filter unit for removing particulate substances suspended in air, said fourth filter chamber unit further comprising a fourth power chamber unit connection means for connecting said fourth filter chamber unit with said power chamber unit; and wherein all of said power chamber unit connection means are able to cooperate with said filter chamber unit connection means to releasably connect said power chamber unit to any of said filter chamber units.

6. The modular vacuum cleaner of claim 5 wherein said filter chamber units further comprise backpack connection means for attachment to a backpack unit for allowing a user to wear the modular vacuum cleaner in a backpack mode, said backpack unit further comprising at least one shoulder strap.

7. The modular vacuum cleaner of claim 5 wherein:

said suction creating means is an impeller powered by an electric motor to establish a suction, thereby creating an airflow in an intake port and out an exhaust port, said power unit further comprises, an on/off means for turning said electric motor on and off, the intake port for receiving air from a filter unit chamber exhaust port, and the exhaust port for exhausting air.

8. The modular vacuum cleaner of claim 7, wherein each of said filter chamber units further comprise:

a filter chamber unit intake port for receiving air containing the suspended particulate substances, said filter chamber unit intake port further comprising a hose attachment means for cooperation with a vacuum hose;

a vacuum hose for direction of suction formed by said suction creating means;

a filter means for separating, filtering, collecting, and storing said particulate substances, thereby creating filtered air; and a filter chamber unit exhaust port for venting said filtered air to said intake port.

9. A modular vacuum cleaner system comprising:

a power chamber unit, said power chamber unit containing a suction creating means, wherein said suction creating means is powered by electrical connection with a power source, said power chamber unit further comprising a filter chamber unit connection means;

at least two separately housed and distinct filter chamber units chosen from the group consisting of a HEPA filter unit, a wet/dry filter unit, a cloth filter unit, a paper filter unit and cyclonic filter unit, said filter chamber units further each comprising a power chamber unit connection means for allowing said filter chamber units to releasably engage said power chamber unit by means of said filter chamber unit connection means;

wherein said power chamber unit connection means is able to cooperate with any of said filter chamber unit connection means to releasably connect said power chamber unit to any of said filter chamber units.

10. The modular vacuum cleaner system of claim 9 wherein said filter chamber units further comprise backpack connection means for attachment to a backpack unit for allowing a user to wear the modular vacuum cleaner system in a backpack mode, said backpack unit further comprising at least one shoulder strap.

11. The modular vacuum cleaning system of claim 9, wherein:

said suction creating means is an impeller powered by an electric motor to establish a suction, thereby creating an airflow in an intake port and out an exhaust port, said power unit further comprises, an on/off means for turning said electric motor on and off, said intake port for receiving air from a filter chamber unit exhaust port, said exhaust port for exhausting air.

* * * * *